US005213472A

United States Patent [19]

Dumais

[11] Patent Number: 5,213,472

[45] Date of Patent: May 25, 1993

[54] INBOARD SERVO FOR MARINE CONTROLLABLE PITCH PROPELLERS

[75] Inventor: Mark S. Dumais, Cumberland, R.I.

[73] Assignee: Bird-Johnson Company, Walpole, Mass.

[21] Appl. No.: 855,902

[22] Filed: Mar. 23, 1992

[51] Int. Cl.[5] ..... B63H 3/08

[52] U.S. Cl. ..... 416/61; 416/157 R; 416/164; 367/99; 91/1; 92/5 R

[58] Field of Search ..... 416/61, 156, 157 R, 416/163, 164; 91/1; 92/5 R; 367/96, 99

[56] References Cited

U.S. PATENT DOCUMENTS

| | | | |
|---|---|---|---|
| 2,307,040 | 1/1943 | Hammond | 416/61 |
| 4,542,652 | 9/1985 | Reuter et al. | 367/99 |
| 4,543,649 | 9/1985 | Head et al. | 367/96 |
| 4,872,811 | 10/1989 | Cavallaro et al. . | |
| 4,906,213 | 3/1990 | Esthimer | 416/157 R |
| 4,964,104 | 10/1990 | Capurka | 367/99 |

FOREIGN PATENT DOCUMENTS

| | | | |
|---|---|---|---|
| 1525720 | 9/1978 | United Kingdom | 367/99 |
| 2199410 | 7/1988 | United Kingdom | 367/99 |

*Primary Examiner*—Edward K. Look
*Assistant Examiner*—James A. Larson
*Attorney, Agent, or Firm*—Brumbaugh, Graves, Donohue & Raymond

[57] ABSTRACT

An inboard servo for a controllable pitch propeller of the force rod type comprises a feedback device comprising a feedback ring located externally of the propeller drive shaft, affixed to the force rod for rotation and axial translation therewith and having a planar surface perpendicular to the propeller drive shaft axis, and a distance-measuring device for substantially continuously detecting the position of the ring, and therefore the position of the force rod. The distance-measuring device directs a high frequency pulsed signal onto the ring surface from a fixed position spaced apart therefrom, detects the signal as it is reflected by the ring surface from a fixed position spaced apart therefrom, and processes the directed and reflected signals to produce a signal indicative of the position of the ring surface based on the time difference between the pulses directed onto the ring surface and the pulses reflected from the ring surface.

3 Claims, 2 Drawing Sheets

INBOARD SERVO FOR MARINE CONTROLLABLE PITCH PROPELLERS

BACKGROUND OF THE INVENTION

A well-known type of marine controllable pitch propeller comprises a pitch-adjusting mechanism in the propeller hub coupled to an inboard hydraulic cylinder by a force rod that extends through the propeller shaft. Usually, the control system for the propeller includes a feedback device that monitors the pitch of the propeller blades, and the inclusion of the feedback device accounts for the conventional use of the term "servo" to refer to the inboard hydraulic cylinder that actuates the pitch-controlling mechanism of the propeller. In a typical inboard servo installation, the servo is interposed in the propeller shaft aft of the gear box, although in at least one commercially available system the servo is built into the output gear of the gear box. In either case, the servo rotates with the shaft. To provide feedback to the control system, it is conventional to detect the longitudinal position of the force rod, which is indicative of the setting of the pitch-setting mechanism and, therefore, the pitch of the propeller blades. Because the propeller shaft and the force rod are rotating and the force rod moves axially within the rotating shaft, the feedback device commonly includes a coupling between the rotating force rod and a non-rotating feedback output element consisting of a special tubular coupling in the shaft having longitudinal slots of a length at least equal to the working stroke of the force rod, arms projecting from the force rod out through the slots, a rotating ring coupled to the arms and a follower riding in an external track on the ring.

U. S. Pat. No. 4,872,811 (Cavallaro et al., Oct. 10, 1989) describes and shows an inboard servo for a force rod-type marine controllable pitch propeller that incorporates a servo feedback arrangement and an emergency lock-up arrangement that work off a common feedback ring located aftwardly of the servo cylinder. Two connecting rods located generally symmetrically with respect to the axis of the force rod couple the feedback ring to the piston for conjoint movement therewith, the connecting rods passing through openings in an end wall of the cylinder in sealed relation. The emergency lock-up arrangement includes at least two threaded locking rods affixed to the cylinder and received freely through holes in the feedback ring in a generally symmetrical relationship with respect to the axis of the force rod and a locking nut received by each locking rod between the feedback ring and the cylinder and adapted to be threaded along the respective rod into engagement with the feedback ring. Upon such engagement, movement of the feedback ring is prevented, and consequently the piston cannot move in a direction away from the feedback ring because of the fixed connection between the feedback ring and the piston afforded by the connecting rods.

While the feedback and lock-up devices of the Cavallaro et al. patent are entirely satisfactory from a functional point of view and have several advantages over other designs, they are relatively expensive to manufacture, especially the feedback follower ring and its bearing and the rods associated with the feedback ring. Also, the rods that connect the feedback ring to the piston are exposed externally, which leaves open the possibility that they can be damaged; any "dings" in the portions that pass through the cylinder end wall are likely to cause leakage from the cylinder, which will make it necessary to replace the damaged rod, and the dings may also damage the seal, requiring its replacement as well.

SUMMARY OF THE INVENTION

The present invention is an inboard servo for controlling the pitch of a marine controllable pitch propeller of the type in which the pitch is controlled by a force rod that is movable axially through the propeller drive shaft. Like all hydraulic servos of the type to which the invention relates, the servo of the present invention has a hydraulic cylinder adapted to be affixed to the propeller drive shaft coaxially with and for rotation with the shaft, a piston in the cylinder coupled to the force rod, an arrangement for supplying hydraulic fluid under pressure selectively to the cylinder on either side of the piston to move the piston and force rod forward or aftward for propeller pitch control, and a feedback device for detecting the position of the force rod and providing a feedback signal that is processed in the propeller pitch controller to provide an output signal that establishes and maintains a desired pitch setting.

The present invention relates to the feedback device. In particular, a servo according to the present invention includes a feedback ring that is located externally of the propeller drive shaft, is affixed to the force rod for rotation and axial translation therewith and has a planar surface perpendicular to the propeller drive shaft axis. A position-detecting device is provided for substantially continuously detecting the position of the ring, and therefore the position of the force rod, by directing a high frequency pulsed signal to the ring surface from a fixed position spaced apart therefrom, detecting the signal as it is reflected by the ring surface from a fixed position spaced apart therefrom, and processing the directed signals and the reflected signals to produce a signal indicative of the position of the ring surface based on the time difference between the pulses directed onto the ring surface and the pulses reflected from the ring surface. In a preferred embodiment, the pulsed signal of the position-detecting device is an ultrasonic signal, such as that produced and detected by a piezoelectric ultrasonic distance-measuring device.

The position-detecting device eliminates the conventional follower ring and its bearing, which provide the position output from the position output ring on the force rod, and the fitting and track by which movements of the follower ring are transmitted to a motion transducer. The elimination of these components affords a significant cost-savings, not only in manufacturing and assembly costs but in maintenance costs as well. The indicator ring on the force rod is easy to make and install, and because it is not in running contact with another component, it does not require lubrication and is not subject to wear. Piezoelectric transducers, which are preferred over other suitable transducers (e.g., those based on light pulses), are available commercially at relatively low cost and are highly accurate and reliable.

For a better understanding of the present invention reference may be made to an exemplary embodiment, taken in conjunction with the accompanying drawing.

DESCRIPTION OF THE EMBODIMENT

Figure 1:
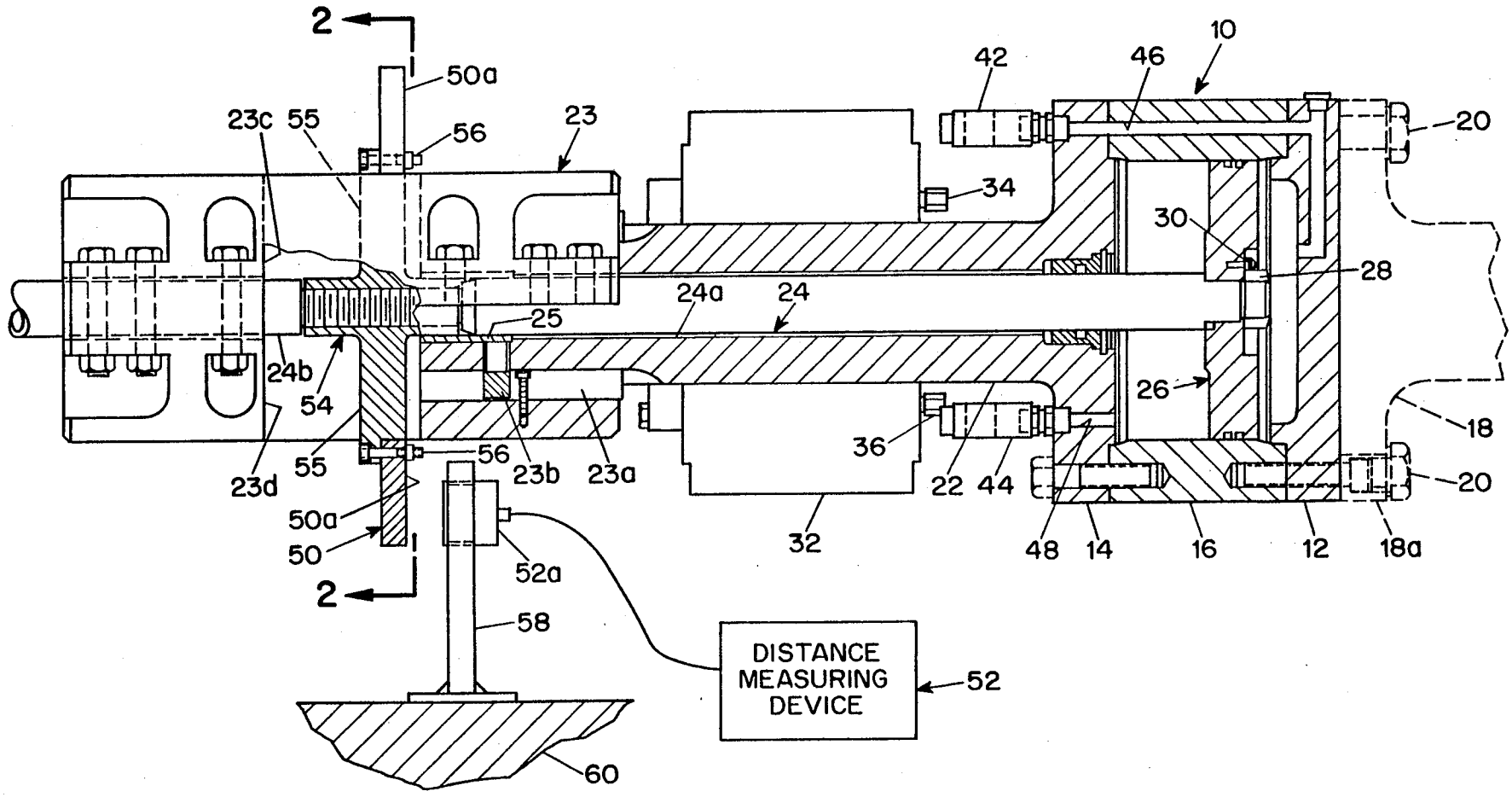
FIG. 1 is a side view of the embodiment, the major part of which is in cross-section taken along a plane that includes the longitudinal axis of the servo.
Figure 2:
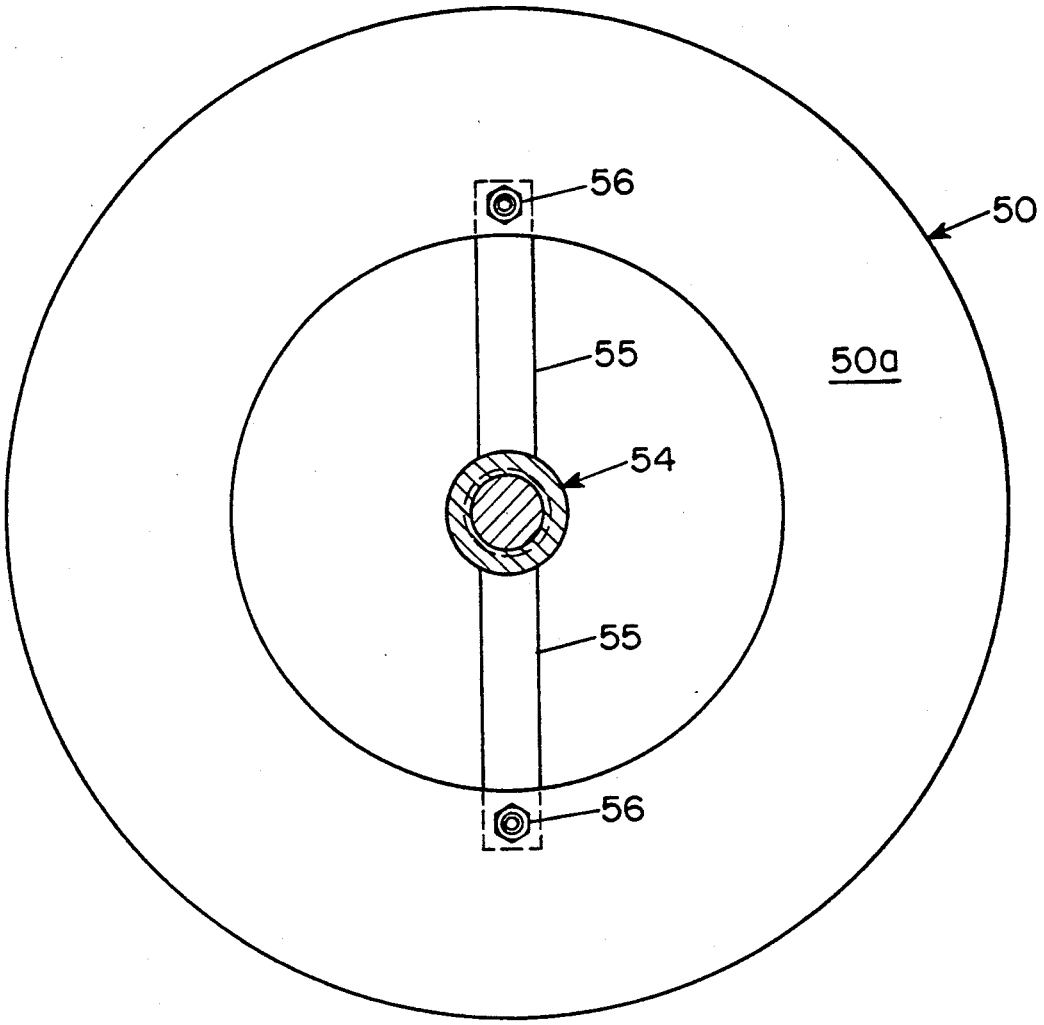
FIG. 2 is an end cross-sectional view of the embodiment taken along the lines 2—2 of FIG. 1 and in the direction of the arrows.

The embodiment comprises a cylinder 10 built up by bolting a fore end wall member 12 and an aft end wall member 14 to a circular-cylindrical peripheral wall member 16. It is designed to be coupled to a flange 18*a* on the output shaft 18 of the ship's gear box (not shown) by bolts 20 and dowels (not shown). The aft end wall member 14 has an integrally formed propeller drive shaft segment 22 that receives a coupling 23 at the aft end for joining it to the forward end of a propeller drive shaft (not shown). The coupling 23 includes keys 23*a* for transmitting torque through the coupling and split thrust rings 23*b* for axial force transmission. A force rod 24 extends aftward through the shaft segment 22 and the propeller drive shaft (not shown) and is coupled to the pitch control mechanism (not shown) of the propeller (not shown). A preferred controllable pitch propeller is described and shown in U.S. patent application Ser. No. 07/437,935 filed Nov. 16, 1989, and entitled "Flange-mounted Controllable Pitch Marine Propeller," but the present invention can be used with virtually any force rod-type controllable pitch propeller.

The forward end of the force rod 24 is affixed to a piston 26 within the cylinder 10 by a nut 28 locked in place by a locking dog 30. An annular rotary seal 32 (shown schematically in outline only), which is received on the propeller drive shaft segment 22 proximate to the aft end of the cylinder 10, includes an inner sleeve member affixed to the shaft and having two fluid distribution grooves in its external surface, an outer stationary sleeve member surrounding the inner sleeve member, and a sealing sleeve member interposed between the inner and outer sleeve members and affixed to the outer sleeve member. The outer sleeve member and seal member have ports that communicate with the respective distribution grooves and are adapted to be connected to hydraulic fluid supply/return lines, and the inner sleeve member has passages leading from the distribution grooves to fittings 34 and 36 affixed to the forward end of the inner sleeve. Tubes (not shown) connect the respective fittings on the inner sleeve to fittings 42 and 44 on the aft end wall member 14 of the cylinder 10 at the input ends of supply/return passages 46 and 48 in the cylinder walls.

When hydraulic fluid is supplied from the rotary seal 32 through the passage 46 to the fore part of the cylinder chamber to drive the piston 26 aftward (to the left in the drawing), the propeller is moved toward maximum ahead pitch; conversely, supply of fluid to the aft part of the cylinder chamber from the rotary seal 32 through the passage 48 drives the piston forward and moves the propeller blades toward maximum astern pitch. A suitable control system, for which many designs are well-known to those skilled in the art, enables the propeller pitch to be set to any desired value between maximum ahead and maximum astern.

An element of most controllable pitch propeller control systems is a feedback device for providing an indication of the actual pitch setting of the propeller. In accordance with the present invention, the feedback device includes a feedback ring 50 located externally of the propeller drive shaft 22, affixed to the force rod 24 for rotation and axial translation therewith and having a planar surface 50*a* perpendicular to the propeller drive shaft axis, and a distance-measuring device 52 for substantially continuously detecting the position of the ring, and therefore the position of the force rod, by directing a high frequency pulsed signal onto the ring surface 50*a* from a fixed position spaced apart therefrom, detecting said signal as it is reflected by the ring surface from a fixed position spaced apart therefrom, and processing the signals to produce a signal indicative of the position of the ring surface based on the time difference between the pulses directed onto the ring surface and the pulses reflected from the ring surface.

In particular, the force rod 24 consists of a forward section 24*a* that extends aftward from the servo piston 26 to a position within the shaft coupling 23, where it is supported by a bushing 25, and a rearward section 24*b* extending aftward from the aft end of the forward section to the propeller. The two sections 24*a* and 24*b* are joined by a threaded tubular coupling member 54. The shaft coupling 23 has diametrically opposite, longitudinally elongated slots 23*c*, 23*d*, each of which receives an arm 55 that is affixed to and extends radially outwardly from the force rod coupling member 54. The detector ring 50 is fastened by bolts and nuts 56 to the outer ends of the arms 55. As the pitch setting of the CPP is changed, in accordance with lengthwise movements of the force rod, the detector ring moves lengthwise correspondingly, and its longitudinal position is indicative of the pitch-setting of the CPP. The sensor component 52*a* of the distance-measuring device 52 is mounted on a bracket 58 that is affixed to a suitable stationary element 60 of the vessel.

A preferred distance-measuring device is an ultrasonic linear distance-measuring system. Such systems are available from several sources. A suitable system is marketed as Model DMI by Contaq Technologies Corporation of Bristol, Vermont. That system employs piezoelectric ultrasonic transducers that propagate ultrasonic pulses onto a remote surface and detect the reflected pulses and electronics for measuring the time interval between the propagated and detected pulses and producing analog and digital outputs in the form of distance measurements. It has an accuracy of plus/-minus one percent and a resolution of 0.007 inch. The distance measurements are readily used in the propeller pitch controller as pitch feedback signals and processed to provide visible pitch indications on displays in the engine room and on the bridge. The measurement system is relatively inexpensive, durable and accurate. It operates without any contact between relatively moving parts, which eliminates the requirement for lubrication and the problem of wear.

I claim:

1. In an inboard servo for controlling the pitch of a marine controllable pitch propeller of the type in which the pitch is controlled by a force rod movable axially through a propeller drive shaft, the servo having a hydraulic cylinder adapted to be affixed to the shaft coaxially with and for rotation with the shaft, a piston in the cylinder coupled to the force rod, means for supplying hydraulic fluid under pressure selectively to the cylinder on either side of the piston to move the piston and force rod forward or aftward for propeller pitch control, and a feedback device for detecting the position of the force rod as an indication of the actual pitch of the propeller, the improvement wherein the feedback device includes a feedback ring located externally of the propeller drive shaft, affixed to the force rod for rotation and axial translation therewith and having a planar surface perpendicular to the propeller drive shaft axis, and distance-measuring means for substantially continuously detecting the position of the ring, and therefore the position of the force rod, by directing a high frequency pulsed signal onto the ring surface from a first fixed position spaced apart therefrom, detecting said signal as it is reflected by the ring surface from a second fixed position spaced apart therefrom, and processing said signals to produce a signal indicative of the position of the ring surface based on the time difference between the pulses directed onto the ring surface and the pulses reflected from the ring surface.

2. An inboard servo according to claim 1 wherein the pulsed signal of the distance-measuring means is an ultrasonic signal.

3. An inboard servo according to the claim 2 wherein the distance-measuring means includes a piezoelectric ultrasonic transducer.

* * * * *